US011905631B2

(12) United States Patent
Zafiroglu et al.

(10) Patent No.: US 11,905,631 B2
(45) Date of Patent: Feb. 20, 2024

(54) DURABLE AND LAUNDERABLE CUSHIONING AND INSULATIVE FABRICS AND STRINGS AND METHODS FOR MAKING SAME

(71) Applicant: Xymid, LLC., Midlothian, VA (US)

(72) Inventors: Dimitri Zafiroglu, Centreville, DE (US); Jason Billups, Northern Chesterfield, VA (US); H. T. Than, Rockville, MD (US)

(73) Assignee: Xymid, LLC., Midlothian, VA (US)

( * ) Notice: Subject to any disclaimer, the term of this patent is extended or adjusted under 35 U.S.C. 154(b) by 0 days.

(21) Appl. No.: 17/736,429

(22) Filed: May 4, 2022

(65) Prior Publication Data

US 2022/0356614 A1 Nov. 10, 2022

Related U.S. Application Data

(60) Provisional application No. 63/184,426, filed on May 5, 2021.

(51) Int. Cl.

| | |
|---|---|
| ***D04B 21/20*** | (2006.01) |
| ***D04B 1/22*** | (2006.01) |
| ***D02G 3/42*** | (2006.01) |

(52) U.S. Cl.

CPC ..... *D04B 21/202* (2013.01); *D02G 3/42* (2013.01); *D04B 1/22* (2013.01); *D10B 2401/04* (2013.01)

(58) Field of Classification Search

CPC ..... D04B 1/22; D04B 21/00; D04B 21/202; D04B 21/10; D04B 21/165

See application file for complete search history.

(56) References Cited

U.S. PATENT DOCUMENTS

| | | | | |
|---|---|---|---|---|
| 2,779,354 A * | 1/1957 | Underwood | D04B 21/202 | 139/394 |
| 2,845,783 A * | 8/1958 | Underwood | D04D 3/00 | 139/393 |
| 3,168,883 A | 2/1965 | Siegfried et al. | | |
| 3,715,878 A | 2/1973 | Kim | | |
| 3,837,943 A | 9/1974 | Ploch et al. | | |
| 4,517,715 A * | 5/1985 | Yoshida | D04B 1/16 | 28/165 |
| 4,891,957 A * | 1/1990 | Strack | D04B 21/165 | 66/196 |
| 5,498,459 A | 3/1996 | Mokhtar et al. | | |

(Continued)

*Primary Examiner* — Danny Worrell

(74) *Attorney, Agent, or Firm* — The H.T. Than Law Group

(57) ABSTRACT

Disclosed is a stitch-bonded string comprising at least one stitched line extending in a machine direction and fibers emanating from the at least one stitched line. The at least one stitched line comprises a plurality of loops and said plurality of loops enclose substantially all of said fibers. The stitched line is gathered to reduce a dimension of the plurality of loops holding said fibers within the loops. The stitched line's weight is less than 20%, preferably less than 10%, and more preferably less than 5% of the total weight of the stitch-bonded string. The fibers have a basis weight ranging between 30 and 400 grams/meter$^2$, preferably between 40 and 350 g/m$^2$, preferably between 50 and 300 g/m$^2$ or between 100 and 250 g/m$^2$. Methods for making the string are also disclosed.

20 Claims, 5 Drawing Sheets

(56) References Cited

U.S. PATENT DOCUMENTS

Figures 1A, 1B, 1C, 1D, 1E, 1F, 1G, 1H:
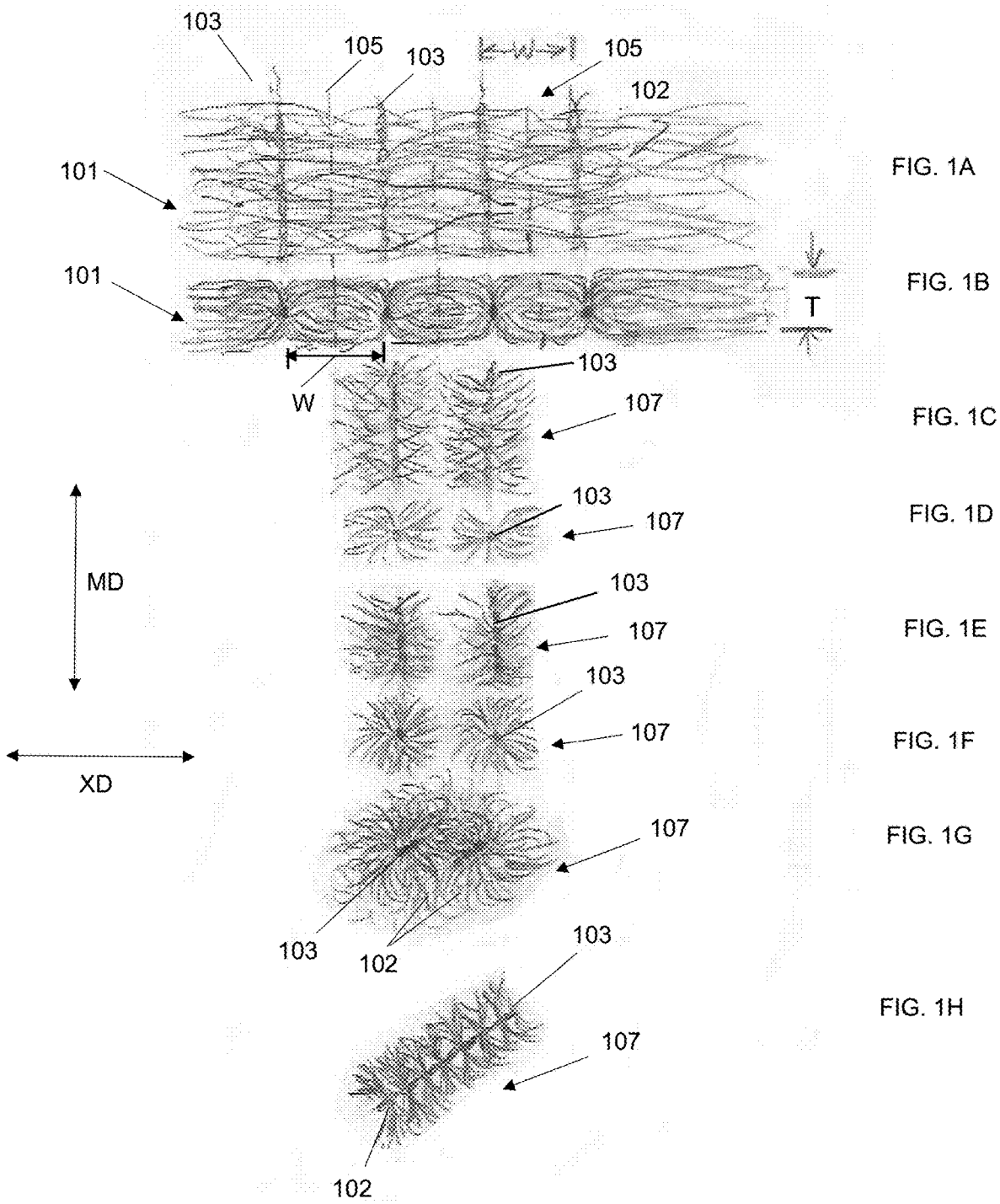

| | | | | |
|---|---|---|---|---|
| 5,651,168 | A | 7/1997 | Tung et al. | |
| 5,879,779 | A | 3/1999 | Zafiroglu | |
| 6,289,700 | B1 | 9/2001 | Gangi et al. | |
| 6,407,018 | B1 | 6/2002 | Zafiroglu | |
| 6,811,870 | B2 | 11/2004 | Zafiroglu | |
| 7,588,818 | B2 | 9/2009 | Zafiroglu et al. | |
| 10,682,215 | B2 * | 6/2020 | Couderc | D04B 21/12 |
| 2004/0115388 | A1 * | 6/2004 | Wildeman | D04B 21/165<br>428/95 |
| 2006/0207077 | A1 | 9/2006 | Holmberg | |
| 2008/0010793 | A1 * | 1/2008 | Wildeman | D06C 23/04<br>28/100 |
| 2008/0166520 | A1 * | 7/2008 | Zafiroglu | D04B 35/06<br>428/136 |
| 2008/0166532 | A1 * | 7/2008 | Tsiarkezos | D04B 21/165<br>112/475.01 |
| 2018/0171519 | A1 * | 6/2018 | Wildeman | D04B 21/165 |
| 2021/0156059 | A1 * | 5/2021 | Zafiroglu | D04B 21/165 |
| 2022/0356614 | A1 * | 11/2022 | Zafiroglu | D04B 21/202 |

* cited by examiner 103
105
103
W
105
102
101

101
T

W
103
107

103
107

MD
103
107

103
107

XD
107

103
102
103

107
102

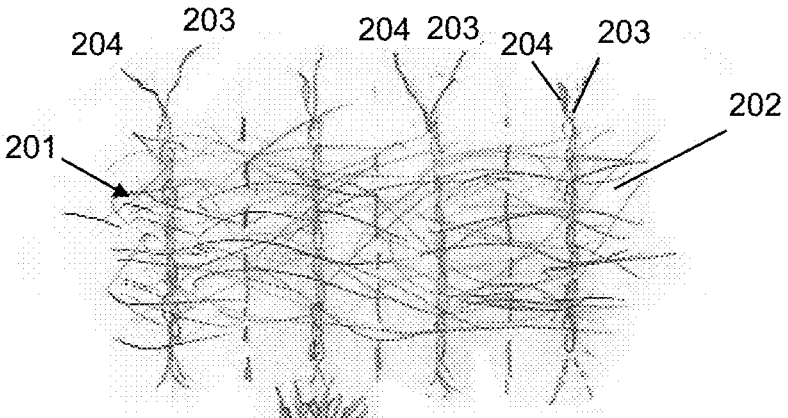
Fig. 2A
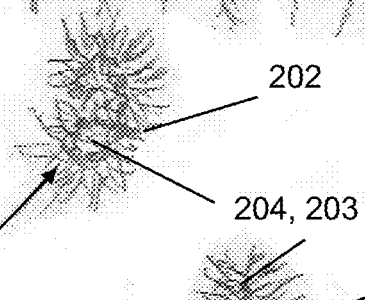
Fig. 2B
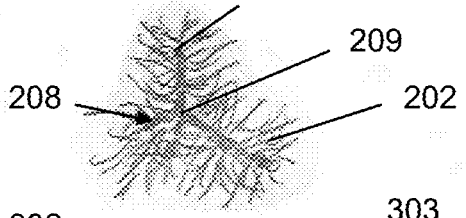
Fig. 2C
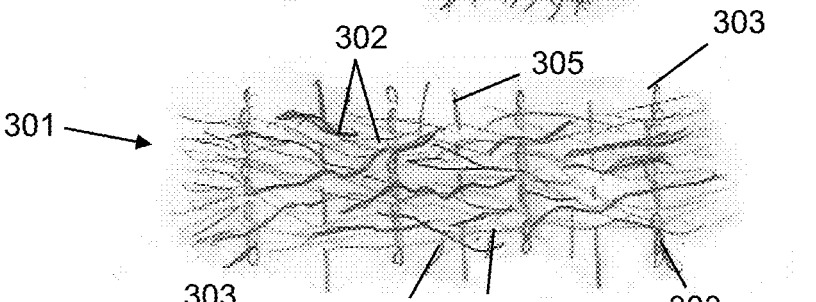
Fig. 3A
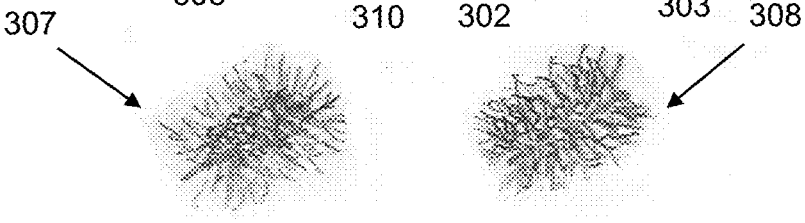
Fig. 3B
Fig. 3C

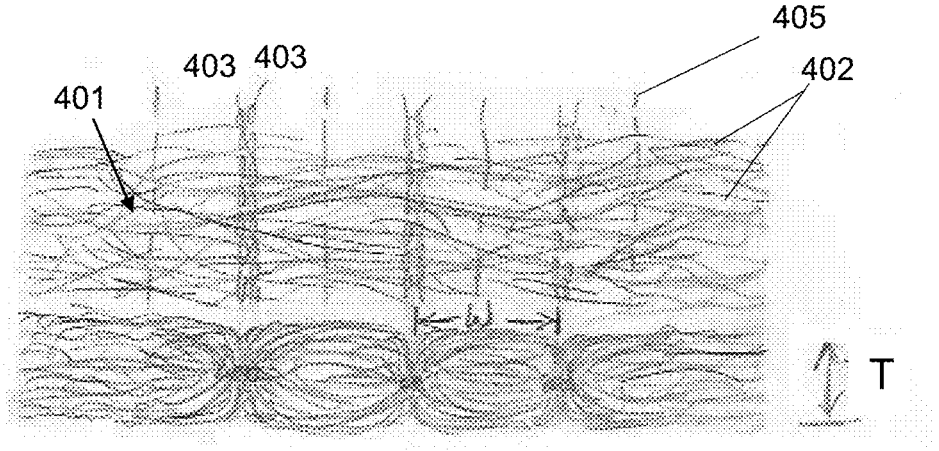
Fig. 4A
Fig. 4B
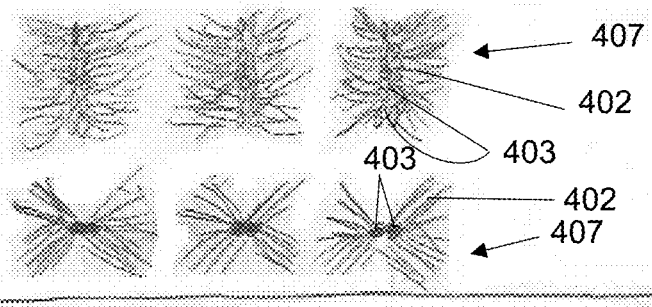
Fig. 4C
Fig. 4D
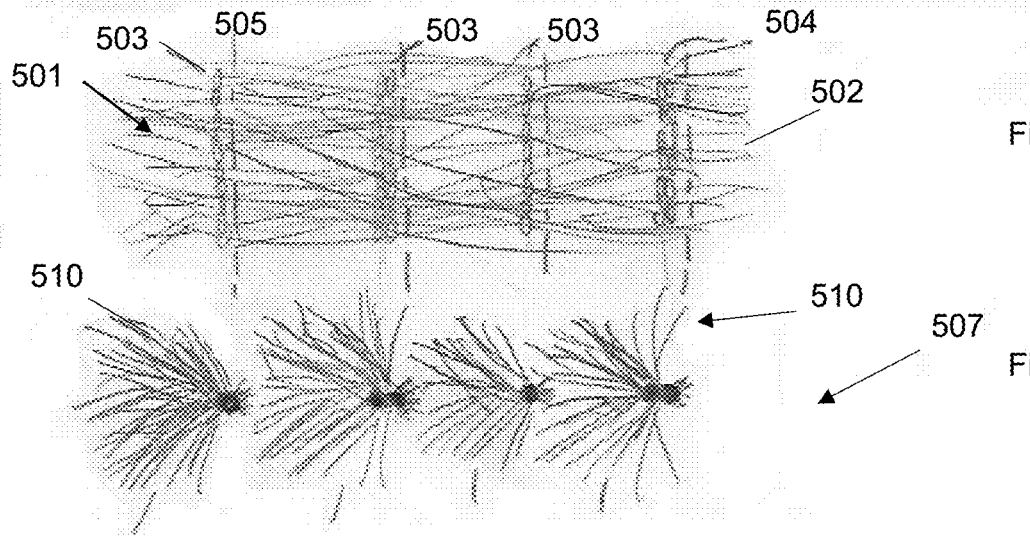
Fig. 5A
Fig. 5B

DURABLE AND LAUNDERABLE CUSHIONING AND INSULATIVE FABRICS AND STRINGS AND METHODS FOR MAKING SAME

CROSS-REFERENCE TO RELATED PATENT APPLICATION

The present invention claims priority under 35 U.S.C. § 119(e) to U.S. provisional patent application No. 63/184,426 filed on 5 May 2021. The parent provisional patent application is incorporated by reference in its entirety.

FIELD OF THE INVENTION

The present invention relates to bulky composite yarns or strings and methods for manufacturing and using them in thermal insulating and cushioning applications.

BACKGROUND OF THE INVENTION

Cushions such as furniture cushions, bedding, insulative apparel, or impact protective apparel use bulky foams or bulky textiles with the fibers preferably oriented in the nonplanar or "fiber-on-end" direction substantially orthogonal to the plane of the cushion. In a similar manner structural or apparel heat insulation relies mainly on bulk and air trapped in a structure. Various forms of loose "fiber-fill" or "feather-fill" or "foam-fill" of "down-fill" are used in insulative apparel, furniture cushion or sleep related products, enclosed within outer protective layers of fabric, with some stitched or bonded at various large intervals. Most commonly such structures require dry-cleaning as they tend to lose their bulk/insulation and cushion through use and after washing and drying. Alternatively fibrous cushioning or insulating sheets are needle-punched. The needle-punching improves durability and vertical "fiber-on-end" directionality and cushion to a limited degree, while it significantly reduces bulk due to the densification by the relatively heavy needling action required for wash/dry durability, even when enclosed within fabric coverings.

Another method available to increase and maintain bulk in a textile sheet is by stitching shrinkable yarns to non-shrinking or less shrinkable substrates using commercially available stitch-bonding or sewing equipment, as disclosed, among others, in U.S. Pat. Nos. 5,879,779 and 6,407,018 to Zafiroglu describing the use of partially oriented yarns (POY) that are introduced into a stitch-bonded fabric. Single or multiple overlaid substrates in commercial stitch-bonders are stitched with stitches repeating with a stitch length up to approximately 4-5 millimeters in the machine direction, and can also include underlaps extending to the same degree in the cross-direction restricted to approximately the same span. This restriction limits the thickness increase created by shrinking in the machine direction and/or cross-direction and buckling the substrate. Arranging for longer stitches and/or longer underlaps would increase the thickness and the bulk but would result in lower processing speeds and lower stability and durability.

Undulated or wavy bulked structures in prior art can also be created by attaching non-shrinking or less shrinking layer(s) to more shrinkable layer(s) at intervals and causing the non-shrinking or less shrinking layer(s) to buckle out of plane to provide both cushion and insulation. U.S. Pat. No. 7,588,818 to Zafiroglu describes examples of highly shrinkable substrates, including shrinkable films, warps of shrinkable yarns, POY yarns, side-by side bicomponent yarns, and elastic yarns, on which various less-shrinking or non-shrinking substrates are attached by adhesive bonding or stitching in rows perpendicular to the orientation of the shrinking layers. Post-shrinkage buckles the attached layers increasing bulk and cushion.

Insulative and decorative yarns, exemplified by "Chenille" yarns, deployed into woven or knit structures have also been produced by various methods, mainly by the introduction of fiber segments between two twisted yarns as described in U.S. Pat. No. 5,651,168 to Tung, forming Chenille yarns with a linear weight in the range of 700 to 300 yards per pound, translating to an upper limit of approximately 10,000 denier. Preformed pile yarns are fed into a Chenille twisting machine to form a peripheral pile of limited length, limiting total bulk and cushion compared to what is required in demanding fiber-fill and insulative applications.

Bonded Chenille-type yarns have also been suggested in the patent literature. U.S. Pat. No. 3,715,878 to Kim discloses cross-directional or randomly oriented filament or yarn or staple webs bonded to cross-spaced machine directional yarn warps, followed by slitting, or pulling apart between bonds. U.S. Pat. No. 5,498,459 to Mokhtar teaches the formation of pile strings intended for subsequent bonding onto a floorcovering substrate by intermittently bonding segments of a pile yarn to a to a central support strand, forming a potentially three-dimensional yarn. Relying exclusively upon bonding to secure the three-dimensionally oriented cross-fibers stiffens the resulting Chenille-type yarns, and limits or substantially eliminates the potential of further bulking or laundering resistance.

US published patent application no. 2006/0207077 to Holmberg teaches Chenille yarns made from cross directional or diagonally oriented or randomly oriented yarn, filament, or staple arrangements, including diagonally arranged preformed fabrics, stitched with linear stitches, and subsequently slit between the stitches, and bulked by mechanical abrasion or pulling or twisting. The bulking and pulling or twisting attachment do not provide for sufficient tightening of the encapsulating stitches, nor tacking or extra friction to secure the enclosed fibers.

U.S. Pat. No. 6,289,700 to Gangi similarly teaches the formation of Chenille yarns by encapsulating cross-directional oriented yarns fed with a reciprocating weft insertion arrangement, into linear warp-directional machine-direction stitches, and slitting between stitches. No mechanism beyond pulling or twisting is offered to further bulk or to further secure the cross-yarn segments within the stitches.

U.S. Pat. No. 6,811,870 to Zafiroglu offers a method of warp knitting, adhesively securing and slitting the cross-directional underlaps across linear machine-directional knit stitches. The bulk is generally uniform along the length of these yarns, and binder is introduced into the knit yarns to produce durable Chenille-type yarns. The size of the Chenille-type pile is, however, limited to the width of the underlaps, which require substantial reciprocating crosswise motion of the guide bar, limiting the cross directionality and the speed of operation.

There remains a need for durable textile structures, including fabrics and strings/strips, that can provide improved bulk and cushion in a linear configuration, for example, a bulky fabric or string allowing the use of staple fibers or filaments or yarns or mixtures thereof in a minimally processed loose form, produced economically at relatively high speeds, and remaining stable and resilient after multiple washings and dryings.

SUMMARY OF THE INVENTION

An embodiment of the present invention is directed to a stitch-bonded fabric comprising a plurality of substantially parallel, preferably linear, stitched lines on a web comprising substantially unbonded fibers, said plurality of stitched lines extending in a machine direction (MD) and the web fibers emanating from the plurality of stitched lines. The plurality of stitched lines comprises a plurality of loops and said plurality of loops enclose substantially all of said web fibers or web filaments. The density of the stitched bonded fabric is less than about 0.020 g/cm$^3$, and a cross-direction (XD) spacing between adjacent stitch lines ranges from a lower limit of about 12.5 mm to an upper limit of about 75 mm.

In one embodiment, the stitched bonded fabric is gathered to reduce a dimension of the plurality of loops holding said web fibers therewithin.

The density of the stitched bonded fabric can be less than about 0.015 g/cm$^3$, less than about 0.010 g/cm$^3$ or less than about 0.005 g/cm$^3$.

The XD spacing ranges can be in any increments of 2.5 mm higher than the lower limit and lower the upper limit. The XD spacing between adjacent stitch lines ranges from 25 mm to 50 mm (1.0 to 2.0 inches) or from 25 mm to 37.5 mm (1.0 to 1.5 inches) or from 12.5 mm to 37.5 mm (0.5 inch to 1.5 inches).

Preferably, the plurality of stitched lines weighs less than 20% of the weight of the stitch-bonded fabric, less than 10% of the weight of the stitch-bonded fabric, less than 5% of the weight of the stitch-bonded fabric, or less than 2% of the weight of the stitch-bonded fabric.

The plurality of stitched lines can be formed by a heat shrinkable yarn, a POY yarn, a high-melt/low-melt yarn or an electrically conductive yarn. The high-melt/low-melt yarn may comprise a high melt yarn co-stitched with a low melt yarn, a core-sheath, or a bi-component yarn. At least one of the plurality of stitched lines may comprise two or more stitched lines. Preferably, the plurality of stitched lines is stitched in a chain stitched pattern.

The web fibers may further comprise at least one of crimped fibers, shrinkable fibers, non-shrinkable fibers, absorbent fibers or electrically conductive fibers.

The stitched fabric may be gathered in its entirety or selectively in section(s) thereof.

In a preferred embodiment, a plurality of strings is cut from the inventive stitch-bonded fabric described above, where each of the plurality of strings contains at least one stitched line. The plurality of stitch-bonded strings is preferably chopped and wherein a MD dimension of said chopped strings is 6-inch, 5-inch 4-inch, 3-inch, 2-inch, 1-inch or ½-inch, any length in between and any combination thereof.

The strings can be cut from gathered stitched fabrics or un-gathered stitched fabrics.

BRIEF DESCRIPTIONS OF THE FIGURES

In the accompanying drawings, which form a part of the specification and are to be read in conjunction therewith and in which like reference numerals are used to indicate like parts in the various views:

FIG. 1A shows a top view of a web 101 of filament or staple fibers 102 stitched with spaced parallel linear stitched lines 103. FIG. 1B shows a cross-sectional view of the stitched fabric in FIG. 1A. FIG. 1C shows the stitched fabric in FIG. 1A slitted into strips or strings 107. FIG. 1D shows an end view of the strips or strings 107 in FIG. 1C. FIG. 1E shows a top view of the inventive strings 107 of FIG. 1C shrunk and tightened. FIG. 1F shows an end view of the strings or strips 107 in FIG. 1E. FIG. 1G shows a perspective view of a pair of the inventive strings 107 of FIG. 1E. FIG. 1H shows one of the inventive strings of FIG. 1C tightened without shrinking in length. W is a distance between adjacent pairs of stitched lines 103 in the cross direction (XD) and T is a thickness of the web 101.

FIG. 2A shows a top view of a web 201 stitched with dual linear co-stitches 203, 204 including one high-melt yarn and one low-melt yarn. FIG. 2B shows an inventive string 207 cut from the stitched fabric of FIG. 2A and allowed to shrink freely and assumed a curled three-dimensional form. FIG. 2C shows another inventive curled shrunk string 208, which was shrunk unevenly along its length to produce an inventive string with a more complex three-dimensional configuration.

FIG. 3A shows a top view of a web 301 containing a portion of higher denier or highly crimped fibers stitched with shrinkable linear spaced stitches 303. FIGS. 3B and 3C show the inventive strings cut off from the web of FIG. 3A and shrunk, with the inventive string 307 of FIG. 3B containing shrinkable fibers and non-shrinkable fibers, and the inventive string 308 of FIG. 3C containing non-shrinkable fibers and highly crimped fibers.

FIG. 4A shows a top view of web 401 stitched with pairs of closely spaced stitched lines 403. FIG. 4B shows a cross-sectional view of the fabric of FIG. 4A. FIG. 4C shows a top view of the inventive strings 407 formed using the pairs of closely spaced stitched lines 403 and slitted along slit lines 405. FIG. 4D shows an end view of the strings from FIG. 4C.

FIG. 5A shows a top view of a web 501 with a combination of single stitched lines and pairs of closely spaced stitched lines and asymmetric/eccentric cut lines. FIG. 5B shows the inventive strings 507 formed with single stitches and double stitches, forming strings wherein the projecting piles are unidirectional.

Figure 6A:
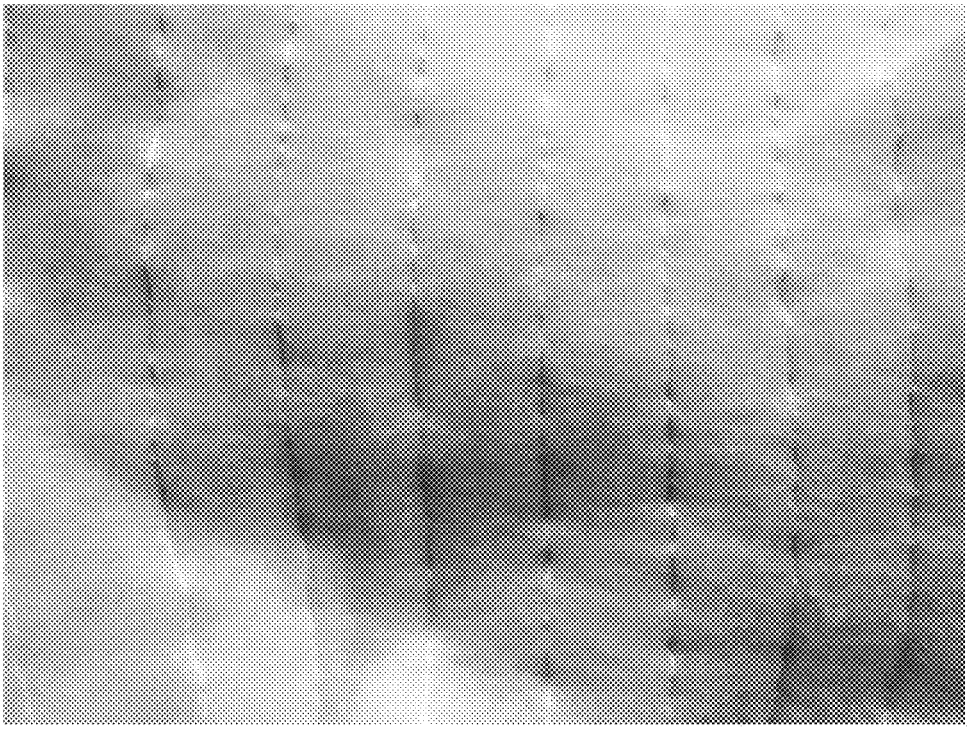
Figure 6B:
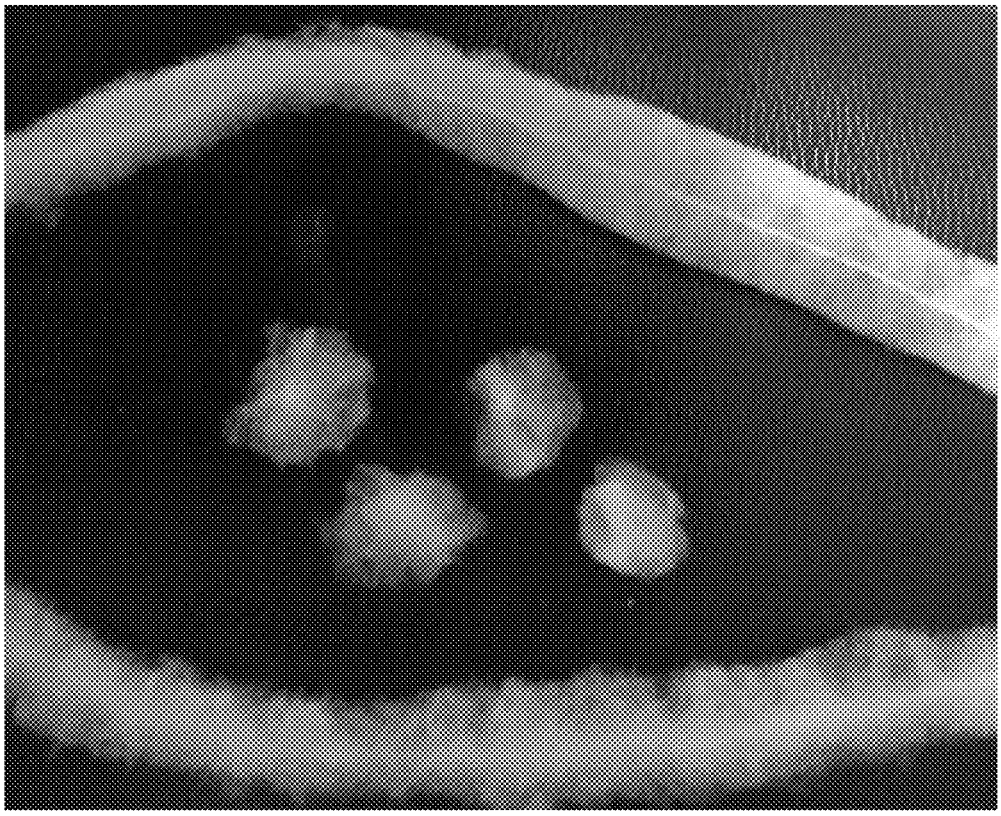
Figure 6C:
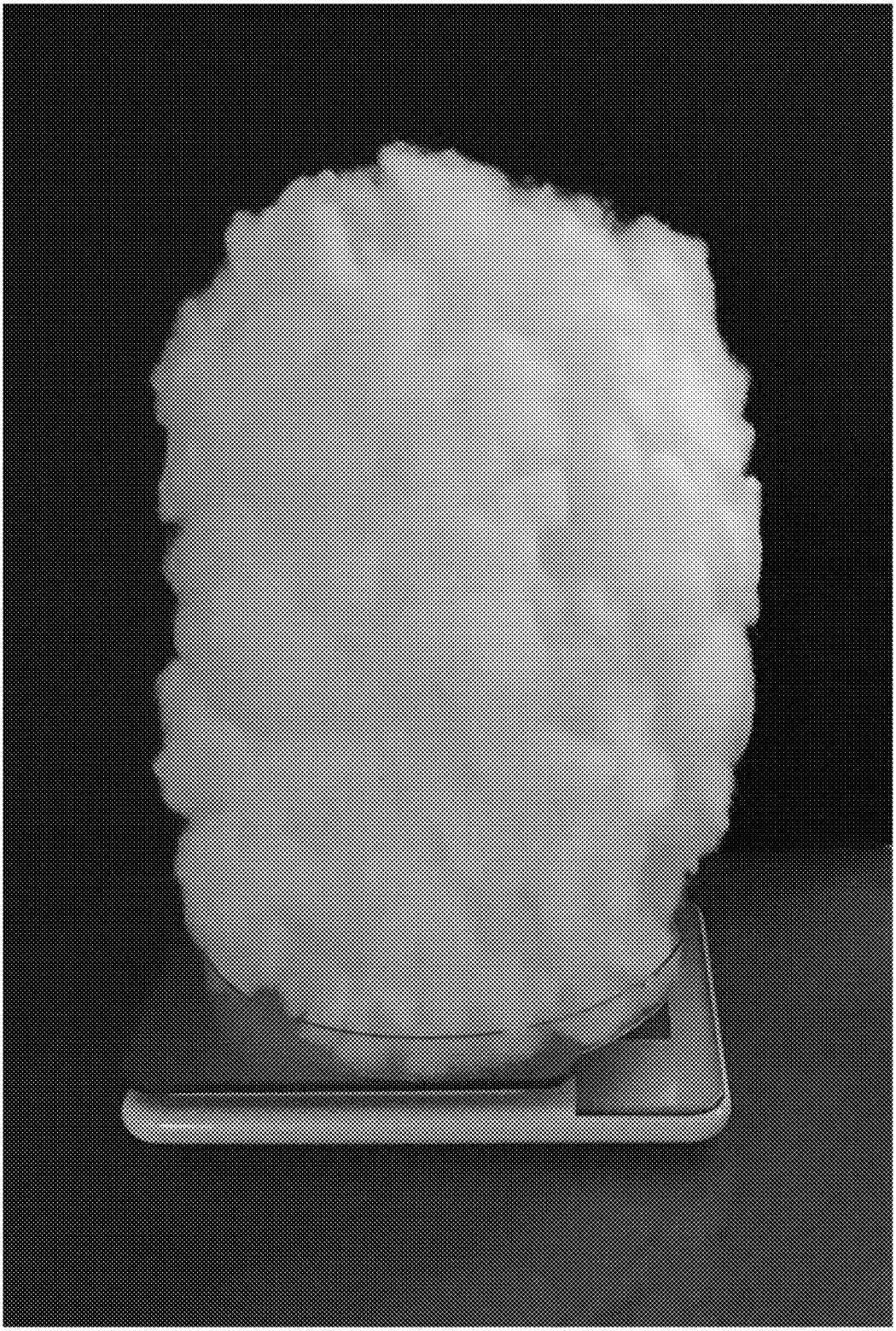

FIG. 6A is a black and white photograph of the inventive stitched fabric. FIG. 6B is a black and white photograph of strings and chopped strings made from an inventive stitched fabric similar to that of FIG. 6A. FIG. 6C is a black and white photograph of a pile of the inventive chopped strings showing its bulkiness and low density.

DETAILED DESCRIPTION OF THE PREFERRED EMBODIMENTS

The inventive strips or strings are preferably used in three-dimensional bulky configurations similar to "fiber-fill," "feather-fill," "down-fill" or "foam-fill," in longer/continuous form or short segment form, that beyond the fiber-fill, feather-fill, down-fill, or foam-fill performance, would maintain overall integrity, bulk, cushion, and softness after multiple launderings.

The present invention is also directed to stitched fabrics that are preferably used in three-dimensional bulky configurations similar to "fiber-fill," "feather-fill," "down-fill" or "foam-fill," that beyond the fiber-fill, feather-fill, down-fill, or foam-fill performance, would maintain overall integrity, bulk, cushion, and softness after multiple launderings. The inventive strips or strings are preferably cut or slitted from the inventive stitched fabrics.

Furthermore, the inventive yarns or strings can simulate or mimic the advantages of feather-fill cushions with a washable, preferably multi-cycle washable, string structure wherein fibers emanate from a sufficiently resilient "backbone," preferably surrounded by soft longer fibers and stiffer shorter fibers providing significant bulk, soft feel and resilience while adding relatively low "backbone" weight, and avoiding a harsh touch by offering adjustable backbone stiffness or low denier weight. Such strings when cut into relatively short segments can also assume various orientations in three dimensions, and can engage and hold in place regular cut staple fiber-fill fibers or loose short fiber segments, or pieces of foam therewithin. Such structures improve resilience and durability at relatively low overall weights. They can also facilitate the use of waste or recycled fibers in a cushioning or insulating structure by supporting the reclaimed or recycled loose fibers with the continuous or short inventive strings.

In a generalized embodiment a bulky, substantially unbonded fibrous web with a density under 0.020 g/cm$^3$, preferably with a density under 0.015 g/cm$^3$, more preferably under 0.010 g/cm$^3$, and more preferably under 0.005 g/cm$^3$, is formed with unbonded or minimally or temporarily-bonded and unentangled or minimally-entangled individual fibers or filaments having a random general directionality, and preferably a directionality closer to the cross direction (XD), and stitched with linear machine-directional (MD) stitches spaced at relatively large cross-intervals varying from 12.5 mm to 75 mm (0.5 inch to 3.0 inches), preferably 25 to 50 mm (1.0 to 2.0 inches), more preferably 25 to 37.5 mm (1.0 to 1.5 inches) or 12 to 37.5 mm (0.5 inch to 1.5 inches). The XD ranges of the spacing may range in any increments of 2.5 mm from the first lower limit of 12.5 mm and the first upper limit of 75 mm.

The stitching may be performed with non-shrinkable textured or untextured yarns, or preferably shrinkable partially oriented yarns (POY) activated and shrunk by subsequent heat, or with elastic/or elastomeric yarns, and the stitches can be caused or allowed to shrink and tighten around the web fibers enclosed by the stitched yarns. The web may optionally contain a low percentage of fibers with a polymeric component that can be melted with subsequently applied heat. The stitches may also optionally include post-activatable low-melt component(s), including in a single yarn or in a second co-knit yarn along the same linear stitch lines. The low-melt component(s) of the stitches may be activated after stitching with or without prior, simultaneous, or subsequent shrinking along the stitch direction.

The bulky, substantially unbonded web of predominantly random or cross-directionally oriented fibers retains most of its bulk and insulative and cushioning properties after stitching by the linear machine-directional oriented stitches placed at the large cross-intervals between stitches discussed above, as the added stitching yarn weight does not exceed 20% and preferably does not exceed 2% of the fabric or the stitched web, thereby minimally contributing to the total weight of the inventive fabric. The original web thickness is essentially unchanged because of the large distance between stitches or stitched lines, that leaves most of the thickness and bulk of the web within the spans between the stitched lines essentially unchanged or fully recoverable. The inventive fabric/stitched web maintains or recovers back to a high bulk and low density under 0.025 g/cm$^3$, preferably under 0.020 g/cm$^3$ or 0.015 g/cm$^3$, preferably under 0.010 g/cm$^3$, more preferably under 0.005 g/cm$^3$. Whereas the inventive fabric/stitched web may have limited abrasion resistance, it is nevertheless durable when deployed between layers of durable fabric or other sheets, as in cushions, pillows, winter-apparel, regular blankets, fire blankets, bed-pads, and the like, or in insulative or cushioning applications over a wall or pipe or other surfaces that are also enclosed or do not require substantial abrasion resistance.

In one embodiment, the inventive fabric/stitched web is rolled to form the partial or total filling of durable and multi-cycle washable pillows or cushions, with the stitch lines extending preferably in the rolling direction or across the rolling direction to resist deformation, clumping and dimensional deterioration. The tightened stitches are sufficient to resist the displacement of the web fibers captured by the stitches to facilitate the direct, economical, and simplified manufacture of highly-supportive ultra-low-weight pillows or cushions or insulative apparel, and the like.

In another embodiment, a cushion or pillow is filled entirely by the rolled inventive stitched web. In another embodiment, the cushion or pillow has a central filling of fibers or foam or other material wrapped by the inventive fabric/stitched web before insertion into or envelopment by a pillow-case or a cushion-case, or before enclosure between outer shell fabrics for apparel or bedding applications. Similarly, the stitched web, with or without the help of low-melt adhesive or subsequent shrinkage, can be used in bedding applications as a highly stable, washable, low-bulk/high-cushion/high-insulation filler requiring a minimum of overlaid quilting.

In another embodiment, strips or strings are obtained by slitting the inventive fabric/stitched web between the widely spaced linear stitches to simulate or mimic bulky and durable Chenille-type yarns that can also serve as improved fiber-fillers for cushions or pillows and the like. The inventive strips or strings can be formed with a total denier in the range of 20,000 to 100,000 grams per 9000 meters while maintaining a bulk above 200 cm$^3$/g or density below 0.005 g/cm$^3$. The inventive strips or strings provide significant advantages in fiber-fill applications, matching or exceeding the performance of "feather-fill" cushions and matching some "down-fill" cushions with a washable, preferably multi-cycle washable, string or nodule structures, wherein long web fibers emanate from and surround the "backbone" formed by the stitched yarns.

In one embodiment, the original web to be stitched contains shrinkable and preferably higher-denier fibers, and less shrinkable and finer/softer denier fibers. After the subsequent heating, the longer finer fibers and stiffer shorter fibers provide significant bulk, soft feel and resilience while adding relatively low "backbone" weight and avoiding a harsh touch by offering adjustable backbone stiffness at a very low weight. Such strings when cut/chopped into relatively short segments, e.g., from ½-inch to 6-inch segments, can also assume various orientations in three dimensions, and can engage and hold in place regular cut staple fiber-fill fibers or loose short fiber segments, or pieces of foam mixed therewithin. Preferably, a MD dimension of the chopped strings is 6-inch, 5-inch 4-inch, 3-inch, 2-inch, 1-inch or ½-inch, any length in between and any combination thereof. The inventive strips or strings in a more continuous or chopped form can be used as insulative or cushioning fillings offering high levels of what is known as "fill power" by occupying a large volume per unit weight/mass (e.g., bulk). In one embodiment, such strings, preferably stitched with high frequencies (high number courses per inch/high CPI), cut to shorter lengths, and preferably post-shrunk, can emulate the structure and the "fill power" of "bird-down," by forming nodules with a short central stitch holding finer and longer fibers emanating in essentially all directions.

The longer individual web fibers emanating from the fabrics/stitched webs, or the slit strings also allow the capture of relatively short waste or recycled fibers co-blended within a cushioning or insulating structure by surrounding, immobilizing, and supporting the reclaimed or recycled loose fibers within or between layers of the inventive fabrics or the continuous or short-cut inventive strings. The web fibers used in constructing the inventive supporting fabrics or strings may be chosen to have a coarser/higher denier and higher crimp for more effective support and immobilization of the interlaid or intermixed shorter recycled fibers.

In one embodiment, the slit strings may include single or dual stitches. In another embodiment, binders are present within the stitches and the strings are optionally twisted with heat and cooled while twisted or afterward to further direct the captured fibers in all directions.

The present invention can develop effective bulk, cushion, or insulation in situ in the form of bulkable and shrinkable strings, or in the form of fabrics/stitched webs, wherein the strings or fabrics are loosely wrapped around complex three-dimensional structures, such as mannequins, pipes, or other objects and then bulked and shrunk with heat. As a further option, it is desirable that such shrinkable and bulkable wrappings could also be activatable by induction when placed directly against body parts to produce form-fitting insulative clothing, or medical wrappings, and the like. Activation by induction is achieved by using electrically conductive fibers, yarns or wires as at least some web fibers or as at least some stitching yarns. Electrical current or an induction field can be applied to the stitched web to heat the electrically conductive fibers or stitched yarns to activate same. Such induction is also disclosed in the literature, including the patent literature, as resistive implant welding (MW), such as U.S. Pat. No. 10,286,609, which is incorporated herein by reference in its entirety.

The present invention further includes embodiments of the inventive linear, planar, or three-dimensional fibrous structure having different degrees of bulking and/or shrinking in different spans or locations preferably to preselected and prescribed degrees, during initial manufacture. After installation on to three-dimensional structures with or without complex or challenging geometry and preferably before end use, a selective application of heat, steam or drying, by induction or by selective restraint bulks or shrinks said linear, planar, or three-dimensional fibrous structure to fit snugly or tightly around said three-dimensional structures. Similarly, such inventive structure can be used in medical applications, such as bandages that can be selective bulked and/or shrunk after being applied to wounds to provide pressure thereon.

Still further the present invention allows the introduction of a percentage of absorbent fibers into the stitched webs and/or the resultant slit strings, supported by non-absorbent fibers that would not soften or collapse with moisture, and helping to draw and transport outwards moisture in applications such as apparel, medical dressings, and the like. The absorbent fiber content in the web can be in the range of 2-20% of the total weight, preferably 2-10% or 3-6%. Alternatively, the absorbent fiber content can be in the range of 2-40%.

The invention also includes an embodiment, wherein highly durable, bulky and insulative fabrics/stitched webs or strings are produced by stitching a parallel pattern of linear stitches spaced at cross-direction (XD) intervals of at least ½ inch or approximately 12.5 mm, preferably at least 1-inch or 25 mm, and as wide as 2 inches or 50 mm, or as wide as 3 inches or 75 mm, into a relatively loose and unbonded web of continuous filaments or long staple fibers with a web basis weight range between 30 and 400 grams/meter, preferably between 40 and 350 g/m$^2$, preferably between 50 and 300 g/m$^2$ or between 100 and 250 g/m$^2$, and an uncompressed density under 0.020 g/cm$^3$, 0.015 g/cm$^3$, preferably under 0.010 g/cm$^3$ or 0.005 g/cm$^3$ using heat-shrinkable or highly-tensioned and elastically recovering elastomeric or non-elastomeric stitching yarns or flat or textured yarns or combinations thereof totaling 25 to 600 denier, preferably 30 to 150 denier, that engage, envelop and tightly hold the loose web fibers. The hold on the fibers by the stitches is preferably tightened by subsequent heat or steam or by inductive treatment causing the shrinkable stitches to tighten. The stitched length may be allowed to shrink as the stitches tighten, or the stitched sheet may be restrained fully or partially, continuously, or variably in the machine direction, as the stitches shrink. As a further and preferred option, low-melt components are included in the stitching yarns, and they are activated preferably without applying pressure, after stitching, with or without linear shrinkage. Binder content, if any, in the stitching yarns is controlled to adjust stiffness and avoid excessive stiffness. Suitable stitching yarns with a low melt component may include but are not limited to bi-component yarns, wherein in one example the low melt component may form a C-shaped cross section, or the portion partially surrounded by the C-shaped cross section. The bi-component stitching yarn may also be core-sheath yarns with the low melt component on the inside or the outside. The bi-component could also be a side-by-side configuration.

In some embodiments, the stitching process is followed by slitting the stitched sheet or fabric between the parallel linear machine-directional (MID) stitches. Slitting may also be performed at any point between the parallel stitches, optionally simultaneously with stitch-bonding by using knives attached to the reciprocating needle bar.

The planar orientation of the loose textile fibers in the web is preferably close to the cross direction (XD), within 30 degrees, preferably within 20 degrees, more preferably within 10 degrees from XD. In the case of cross-lapped or randomly laid filament webs, such as "spun-bond" webs that have not been bonded, and at most minimally tacked, substantially all of the fibers are held within the stitches. In the case of carded and cross-lapped staple webs the staple length versus the space between stitches is selected so that, after slitting, substantially no staple fibers, or only a small percentage of the total staple content, amounting to less than 20% or less than 10% and preferably less than 5% remains among the fibers emanating sidewise from the stitches without stitching support or without being held by a stitch. Slitting transforms the stitched fabric into a number of strips, and each strip becomes a string with at least one line of stitched yarn in MD running along the strip or string.

The web in certain embodiments may comprise continuous filaments or long staple fibers that are predominantly oriented at angles larger than 45 degrees from MD, less than 30 degrees from MD, or less than 15 degrees from MD. The orientation of continuous filaments in the web is not as critical, as all continuous filaments are engaged, even if some filaments are oriented at small angles from MD. The majority of the over-stitched relatively loose staple fibers are preferably long fibers and are engaged by 2 or more parallel machine-directional stitches, leaving a very small percentage of fiber length unsupported between stitches, amounting to less than 20% or preferably less than 10% of the web weight, preferably less than 5%, more preferably less than 2% of the total fiber mass. In one embodiment, the MD stitches combine shrinkable or non-shrinkable yarns and low-melting yarns, or yarns containing components that can be heated by induction heating and forming opposed stitches within the same stitching line, serving to increase durability by melting as heat is applied with or without simultaneous shrinking.

In selected embodiments, the web introduced into the stitch-bonding machine is formed by cross lapping carded staple fiber layers, with and without added filament warps and/or continuous spun-filament webs fed into a cross lapper. In other embodiments, the web is formed exclusively with cross-lapped continuous filaments or yarns. After cross lapping, the multilayer web may be very lightly needled or tacked to allow transfer and handling capability into a stitch-bonding machine using a low level of needle penetrations per $cm^2$. Preferably, the web is not needled but moderately compressed to temporarily reduce bulk and increase cohesion to allow transfer and handling into the stitch-bonding machine without permanently collapsing, and without preventing the development of bulking after slitting. In one embodiment, the web may be temporarily pre-stabilized with water-soluble light binder such as starch, removable afterwards by laundering and simultaneously bulking after stitching, and before or after slitting or cutting into shorter lengths.

In selected embodiments, the stitching yarns comprise highly shrinkable partially oriented (POY) yarns or elastomeric yarns under tension. The shrinkable or non-shrinkable stitching yarns may be co-spun or co-stitched with yarns containing low-melt fibers, or filaments or powders or coatings that are subsequently activated with heat. The stitching yarns may include staples, filaments or powders or coatings that add electrically conductive and optionally ferromagnetic components that can be heated by induction to melt the surrounding thermoplastic components and secure the enveloped fibers to improve durability. The heating or induction process may be performed under low tension or no tension allowing the simultaneous shrinking and bulking of the enclosed fibers. Alternately, thermal, or inductive heating is performed with the stitched web or slit string under tension allowing tightening of the stitches around the enclosed fibers without shrinking or curling the string. It may be also performed with variable tension along the length of the stitched fabric or string to allow bulk variations along the fabric or string.

In one embodiment, the slitting between linear stitches is preferably performed in-situ during the stitching process, more preferably using stitching needles converted into reciprocating slitting blades, as normally practiced in the stitch-bonding art. In one embodiment, the slitting needles between stitches are fitted with wider blades than normally used in the art to enable slitting between stitches spaced at large intervals. In one embodiment, the web is held flat with curved stationary fingers or rotating rollers between stitches as it is penetrated by the stitching needles and simultaneously slit by needles converted into blades in the embodiments where strings are produced. Alternatively, the slitting process can be accomplished downstream or at a later time.

In one embodiment, the shrinking of the stitches in the stitching yarns and/or activation of the low-melt component(s) within in the stitching yarns is/are performed in-line as the formed fabric of the slit strips proceed under adjustable tension towards a collecting roller collecting the resulting Chenille-type strings.

In one embodiment, the slit strings are collected loosely in a container and heat is applied allowing the strings to shrink, and in many cases curl-up. In one embodiment the stitched strips are cut into various lengths before they are shrunk or bulked.

In selected embodiments, the continuous strips are bulked after being wrapped around or installed on various objects or body parts to conform as they are bulked by shrinking. In one embodiment the slit strings are fed through a heated opening and simultaneously twisted to enhance the multi-directional emanation of cut fibers from the central stitch. In another embodiment, the slit strings contain low melt components and shrinkable yarns, and the slit strings are twisted, heated, and cooled, and then cut into short segments, which are subjected to blowing and bulking with hot air and agitation to create nodules with maximum bulk and "fill-power." In another embodiment, the stitching yarns are partially oriented yarns (POY) and are highly cold-stretchable, and the stitched fabric or string is cold stretched before being slit, followed by the application of heat, such as blown hot air, to promote a more random orientation of fibers emanating from the stitches. In another embodiment, the stretched strings are cut to short lengths and subsequently shrunk and bulked with blown hot air to create nodules, with some of them assuming a twisted shape, wherein fibers emanate in all directions.

In fiber-fill application embodiments, the continuous or chopped strips are optionally mixed with staple fibers while bulk is developed by releasing tension or applying heat or by exposing to an induction field. In one embodiment, the fiber-fill may contain various percentages of added short or long staples, high-denier, and low denier staples, along with various lengths of the inventive strings. In the case of strings produced with webs containing staple fibers, the strings may also contain the ends of staples that are not encapsulated by the stitches. The inventive strings, in continuous or cut length form, engage, and hold the loose fibers and maintain bulk under pressure or under washing and drying conditions.

In some embodiments, the fiber-filling mixture may also contain loose liquid absorbent fibers, supported, and engaged by the resilient continuous or chopped strings. In some embodiments, the stitched web itself and the resultant strings include absorbent fibers.

In all embodiments, the stitching yarn weight is less than 20%, preferably less than 10%, and most preferably less than 5% or less than 2% of the total weight of the stitched webs, slitted strips, chopped short strings or Chenille-type longer strings. Preferably, the unstitched web has a basis weight ranging between 30 and 400 grams/meter$^2$, preferably between 40 and 350 g/$m^2$, preferably between 50 and 300 g/$m^2$ or between 100 and 250 g/$m^2$.

In some embodiments, pairs of closely spaced stitched lines forming one combined stitched line in fabric or string form, are preferably from 0.5 to 1.5 mm apart. These pairs replace the single linear stitched line, improving the hold on the encapsulated fibers. The paired stitched lines may be opposing or synchronous. One or both may be shrinkable, and one or both may have low-melt contents. More than a pair of stitched lines can also be utilized.

In some embodiments, the continuous bulked or un-bulked strips/strings or the chopped bulked or un-bulked sections of the strips/strings are introduced into weaving, knitting or nonwoven processes, by themselves or along with standard staple fibers or yarns, to form insulative or cushioning or decorative fabrics or cushion filling materials. Strings formed exclusively with filament webs can be used directly as highly bulky and durable Chenille-type yarns, as they are devoid of loose short fiber ends not engaged by the stitches.

In selected embodiments, the bulked or un-bulked strips may be formed with webs including a blend of high-denier and low-denier, or high-crimped and low-crimped fibers, to produce a high cushion/high softness effect. In selected embodiments, the substrates include cellulosic or other absorbent fibers, optionally mixed with a low percentage in the range of 1%-15% or 1%-5% of stiff highly abrasive crimped fibers. As another option, a low amount of binder fibers, preferably in the range of 1%-5% are included in the web to improve durability without undue levels of stiffness. The binder in the web preferably melts at a higher temperature than the low melt component within the stitches, and it is preferably activated after the stitches are tightened and set by cooling, and the strings or fabrics are shrunk and/or bulked before they are placed in a cushion, insulative layered composite, or other similar arrangements.

In selected embodiments, the shrinkage is controlled along the strings by varying the tension or looseness, or heat or induction, as the strings are subjected to heat or induction, to form high shrink/high bulk and lower shrink/lower bulk sections for decorative or functional purposes, such as curling of the strings, improving resilience against compression.

In selected embodiments, the substrate contains fibers that shrink with heat or steam, producing bulked strings with shorter stiffer and resilient fibers and with longer softer fibers emanating from the same central stitch resulting in initially soft and progressively stiffer compressive response for greater cushioning comfort.

In selected embodiments, the stitched strips/strings can be processed through openings providing intermittent tangential hot air to twist the resulting strips/strings as they are bulked. In other embodiments, the string can be intermittently tacked with hot air to create thin and thick bulked/un-bulked intervals. In some cases, the intervals and the applied heat are variable along the treated length.

In selected embodiments, the linear stitches include secondary yarns that melt at a lower temperature than all other components, facilitating high durability and enabling pattern bonding or embossing the surfaces of the fabric, strips/strings or structures manufactured therefrom, without losing significant bulk.

In one embodiment, the shrunk and bulked fabric or strips/strings are heat-set in a linear non-curled form before deploying into a fabric-forming or fiber-filling process. In one embodiment, the fabric or strips/strings or sections thereof are allowed to shrink freely and curl-up and self-twist to increase bulk further.

In selected embodiments, the length of the shrunk or unshrunk chopped string is shorter than the distance between stitched lines of yarn and the fibers emanating from and projecting outwards from the chopped stitched strings, form a structure emulating bird down. The stitch length may be originally short by using a high frequency of linear stitches (high CPI), optionally further shortened by causing or allowing the stitch to shrink before or after slitting or chopping into small lengths.

In one embodiment, a higher melting shrinkable stitching yarn is co-knitted with a low-melting yarn and the low melting yarn melts as the shrinkable yarn shrinks to further improve durability. In one embodiment, the two linear stitches are opposing 10-01/01-10 "chain" or "pillar" stitches.

In another embodiment, the stitching yarn is a composite low-melt/high melt yarn, such as a bi-component or core-sheath yarns. In another embodiment, the stitching yarn is a composite of a POY and a low-melt yarn, and the stitched sheet/fabric or slitted strip/string is stretched and set as the low-melt component melts, and the POY yarn is set.

In yet another embodiment, a fiber-fill cushioning structure containing the inventive bulkable strings in a continuous or chopped form is subjected to heat or induction heating after filling or forming the cushioning structure to bulk within or around the merchandise, thereby enabling the shipment of the merchandise in compact form.

In another embodiment, the stitched sheet/fabric or the slitted strip/string or a fabric formed with the inventive shrinkable strings using heat is shrunk in-situ by applying localized or generally applied heat, as it is placed over an object or mannequin to provide conformable insulation. In yet another embodiment, particularly preferred when the activation is performed over live subjects such as on arms, legs, or torsos for medical purposes or for close-fitting of insulative or impact-resistant clothing, induction heating technology is employed to localize the heating.

Preferably, substantially all of the web fibers are enclosed within said plurality of loops on the stitched lines. Alternatively, at least 70%, preferably at least 80% and more preferably at least 90% of fiber are enveloped and held by at least one stitch on the at least one stitched line. The web fibers preferably comprise at least one of continuous filaments, staple fibers, crimped fibers, shrinkable fibers, and non-shrinkable fibers. The fibers can be substantially unbonded or unbonded.

Another embodiment of the present invention is directed to a process of stitch-bonding an unbonded web of staple fibers, filaments or yarns with a basis weight ranging from 30 to 400 g/m$^2$, preferably between 40 and 350 g/m$^2$, preferably between 50 and 300 g/m$^2$ or between 100 and 250 g/m$^2$, an average directionality ranging less than 30 degrees from the XD, with linear MD stitches spaced 12.5 mm to 75 mm apart using shrinkable yarns. The inventive process comprises the steps of

- causing or allowing the stitches to tighten by reducing tension or applying heat,
- slitting the stitched web between the stitches before or after the tightening,
- forming strings wherein the stitches holding the generally cross-directional fibers constitute less than 20% of the total string weight, preferably less than 10%, most preferably less than 5% or less than 2%.

The tightening step may be conducted under at least partial MD restraint or alternatively free of constraint.

Referring to an embodiment shown in FIGS. 1A-1H, web 101 is stitch-bonded with linear parallel, or substantially linear parallel stitched lines of yarns 103 in MD, preferably with a chain stitched pattern as shown in FIG. 1A. Web 101 preferably comprises individual staple fibers 102 or continuous individual filaments 102 or mixtures thereof. Preferably, web 101 is unbonded or only slightly and temporarily bonded with removable adhesives such as light starch, for handling, so that the individual fibers are movable relative to each other and are free to bulk or gather, as discussed herein. Web 101 is preferably unentangled or slightly tacked so it retains most or all its high as-formed thickness and bulk between the widely spaced stitched lines 103 after being compressed during the stitching process. The overall density of web 101 is preferably under 0.020 g/cm$^3$, preferably under 0.015 g/cm$^3$, preferably under 0.010 g/cm$^3$ and more preferably under 0.005 g/cm$^3$. Stitched lines 103 are preferably spaced at least about 12.5 mm or ½ inch to about 50 mm or 2-inch apart, and can be as far apart as 75 mm or 3-inch, as discussed above and shown by distance W, in FIG. 1B. Distance W is measured along XD and its upper or lower range can be anywhere from 12.5 mm or 75 mm in increments of 2.5 mm as the upper and lower limits of the range. In other words, distance W may range from 15 mm to 40 mm, 20 mm to 47.5 mm, 22.5 mm to 27.5 mm, 25 mm to 70 mm, etc. Preferably, most of fibers 102 in fabric 101 are enveloped or captured and held by at least one stitch in stitched line 103. Preferably, at least about 70% of the fibers 102, more preferably at least about 80% of the fibers and more preferably at least about 90% of the fibers 102 in fabric 101 are captured and held by at least one stitch in stitched line 103. Due to the relatively large distance W between the stitched lines 103, web 101 maintains or recovers most of its original bulk and thickness T between the stitches.

After the stitching, the stitched fabric having a cross-section as illustrated in FIG. 1B is cut or slit along cut lines 105, which in one embodiment are located about half-way between stitched lines 103, to form strips/strings 107 as shown in FIGS. 1C and 1D. In other embodiments such as those illustrated in FIGS. 5A and 5B, the cut lines can be closer to the stitched lines. In another embodiment, the stitched fabric can also be used without being cut into strips, as discussed further below, and a strip/string 107 may contain multiple stitched lines 103, i.e., not all cut lines 105 are cut. Strips/strings 107 are preferably shrunken, gathered, or bulked in MD to form durable and resilient strings, as shown in FIGS. 1E and 1F. Some gathering or bulking in XD is acceptable. The stitching yarns that formed the linear stitched lines 103 are preferably shrinkable when exposed to heat and/or steam. Particularly soft and resilient structures, akin to "bird down" shown in FIG. 1G can be produced using lower-denier web fibers 102 and stitching yarns 103, with or without the introduction of slight amounts of binder into the yarns, as in the case of low-melt powder post-activated with heat or steam.

Alternatively, the stitching yarns may also include an induction-sensitive element, i.e., electrically conductive fibers or powders, and when electrical energy is conducted therethrough the induction element can rise in temperature and shrink the shrinkable stitching yarns, optionally after strips/strings 107 or the stitched fabric with multiple strips/strings 107 is wrapped about a 3-D object to insulate or cushion the object. Alternatively, the stitching yarns are elastomeric and were stitched under tension, and the tension is released after the slitting step to gather strips/strings 107 or to gather the stitched fabric. As shown in FIG. 1C versus FIG. 1E, bulked string 107 has higher density of fibers 102 in MD. The stitches in stitched lines 103 are also tightened by the bulking/shrinking operation to increase the holding power of stitched lines 103 on web fibers 102. FIGS. 1C and 1D show a top view a cross-sectional view, respectively, of the string 107. FIGS. 1E and 1F show a top view and a cross-sectional view, respectively of the shrunken strings or bulked strings 107.

FIG. 1G shows a perspective of a couple of short-cut, shrunk strings manufactured with finer and longer fibers and yarns, preferably shrinkable, and more preferably containing a small amount of post-activatable fibers, and most preferably twisted as they are shrunk and activated, to simulate the nodules of bird-down, with maximized "filling power." In one embodiment the stitches are formed with partially oriented yarns, and the strings can be cold-stretched before shrinking with heat to further randomize the direction of fiber emanation from the stitch. In one embodiment the cold stretched string is cut to short lengths and shrunk and bulked with agitated hot air to further randomize the emanating fibers and achieve a "nodule" similar to FIG. 1G.

FIG. 1H illustrates a variation of the embodiment shown in FIGS. 1C-1G. The stitches in stitched line 103 can be tightened to increase the holding power of the stitches on to fibers 102 without shrinking in length. In this variation, the stitching yarns are shrinkable by heat and/or steam and strips/strings 107 are held stationary at both ends while being exposed to heat and/or steam to tighten the stitches while minimizing or totally preventing the reduction in length in MD. FIG. 1H shows a lower fiber density Chenille-type string maintaining secured grip on fibers 102.

The inventive stitched fabric in any embodiment of the present invention is preferably slit between the stitches as it is being stitched. The shrinkage may simply tighten the stitches if the stitched fabric or the slit string is restrained against longitudinal shrinkage as in FIG. 1H, or it may shrink the length of the fabric or the strings by as much as 50% or more, as in FIG. 1E.

In another embodiment, the bulked or gathered Chenille-type strings possess a more irregular shape. As shown in FIG. 2A, web 201 with fibers 202 is similar to web 101, and two types of stitching yarns are used to form one stitched line. Higher-melt or low-shrinking yarn 203 and lower-melt or high-shrinking yarn 204 are co-stitched as dual linear stitches. Higher-melt and lower melt mean different melting or activation temperatures, so that the lower-melt yarn would activate earlier and would shrink/gather earlier than the higher-melt yarn, so that strips/strings 207 would curl when exposed to heat, steam, or induction heating, as shown in FIG. 2B. The same effect can also be achieved by using high-shrink and low-shrink yarns. The irregular bulking of strings 207 improves their volume and increases the air that the strings trap. The shrinking or gathering can be applied unevenly along stitched lines 203, 204 to produce complex 3-D configuration. As shown in FIG. 2C, more heat is applied at bend 209 to shrink at that location first before the rest of the string is shrunk or gathered to produce a bent string 208.

In the embodiment illustrated in FIGS. 3A-3C, web 301 comprises higher denier fibers 310, i.e., larger diameter fibers, in addition to lower denier fibers or filaments 302. Wed 301 is stitch-bonded with shrinkable yarns 303, similar to the embodiments described above. Strips 307 are cut along cut lines 305, and are bulked or gathered to form Chenille-type strings 307, 308 as illustrated in FIGS. 3B and 3C. Fibers 310 may also be non-shrinkable fibers or highly crimped fibers. String 307 illustrated in FIG. 3B comprises fibers 302, non-shrinkable fibers and/or highly crimped fibers 310. FIG. 3B shows shrinkable fibers 302 receding towards the stitch and non-shrinkable 310 fibers remaining extended outwards, providing a soft initial cushion with extra eventual support as the softer outer fibers 302 are compressed into the shrunk fibers. FIG. 3C shows inventive string 308 containing non-shrinkable fibers and highly crimped fibers shrinking to the same degree and providing more continuous stiffer cushion.

The embodiment shown in FIGS. 4A-4D is similar to that of FIGS. 1A-1D, except that the stitched line 403 comprises more than one stitched line. A pair of closely spaced stitched lines are shown in FIGS. 4A and 4B, and more than two stitched lines can be grouped together as a line 403. FIG. 4C shows Chenille-type strings 407 after they have been slit from stitched fabric 401 and gathered/bulked in MD. FIG. 4D shows an end view of Chenille-type string 407 with two (or more) stitched lines 403 holding fibers 402 in place to increase the hold on fibers 402 and any other fibers discussed herein.

FIG. 5A shows yet another embodiment, where the cut lines 505 are located close to a stitched line 503, which can be a single stitched line or multiple stitched lines, as shown. The bulked and gathered Chenille-type strings 507 shown in FIG. 5B have a head 509 and a fluffy tail or projecting piles 510. Strings 507 advantageously can trap more air in projecting piles 510 to increase its insulative property. Other embodiments can include Chenille-type strings with two heads 509 located on opposite longitudinal sides in MD with fibers 502 in between and Chenille-type strings with one head 509 and two projecting piles 510 emanating therefrom.

It is noted that one or more elements from any embodiment can be used with any other embodiment described herein. For example, the double stitched lines can be used in any embodiment, and any type of fibers can be used in all embodiments, as well as the asymmetric cut lines. Any method of gathering, bulking, or shrinking, which have similar or the same meaning as used herein, can be used with any embodiment. Additionally, Chenille-type strings 507 shown in FIG. 5B can be cut into short segments along MD and fishing hooks can be threaded through heads 509 to form artificial flies for fly fishing.

In another embodiment, the inventive method further comprises the step of shrinking the composite string performed in situ over an object, such as a mannequin, a pipe or tube, machinery, or part(s) thereof, or merchandise prior to shipping or storage, to add surface bulk, insulation, or protection with a profile.

The method of the present invention can be used to insulate and cushion objects with challenging geometries in situ, i.e., performing the bulking/heat-shrinking step after these objects are wrapped with the inventive composites. These objects include, but are not limited to, piping and plumbing; oil wellheads or Christmas trees; mannequins; boats, personal water-craft (jet skis) and other marine vehicles before storage; generators; etc. Other applications include, but are not limited to, bandages; compression leggings/sleeves to stop bleeding or to stop swellings; compression wraps on limbs of equine athletes; casts for broken limbs and bones when thermoset and/or thermoplastic components are incorporated therein; coverings that release fire retardants or odor absorbents; insulations for extreme high or low temperatures. The present invention is not limited to any particular applications.

As shown herein, the inventive strings can be optimized to meet any specific application or requirement, by varying denier, crimp and shrinking levels.

Example 1. Filling with the Slit Strings

A polyester web of 2.5-inch, 3 dpf polyester fibers is carded into a 0.8 oz/yd$^2$ (27 g/m$^2$) layer and cross-lapped into a 4.5 oz/yd$^2$ (153 g/m$^2$) structure with a cross angle of approximately 80 degrees from MD and 10 degrees from XD direction. Since the carded fibers are mostly along the original carding machine direction, the majority of the cross-lapped fibers is oriented by an average of approximately 10-15 degrees from XD.

The lapped web is rolled with a layer of paper for handling and unrolled/released into a stitch-bonding machine. The unrolled web has an approximate free thickness T of 0.75 inch or 18 mm corresponding to a density of approximately 0.008 g/cm$^3$.

The lapped web is temporarily compressed to allow introduction into a stitch-bonding machine and stitched with 250 denier POY polyester yarns with approximately at 8 courses per inch (8 CPI), using 0/0-1/1 chain stitches spaced one-inch apart (1 miss 13 on a 14-gage machine). Yarn weight per square yard is only about 0.14 oz/yd$^2$ (5 g/m$^2$), or about 3.0% of the total weight of the stitch-bonded fabric. Free thickness, T, as stitched is approximately 0.7 inch, and free density approximately 0.009 g/cm$^3$ as stitched with the sections in width W between the stitches rising back to 0.7 inches unimpeded. As shown schematically in FIGS. 1A and 1B. The stitches essentially disappear within the stitched web and substantially all 2.5-inch cross lapped fibers with the predominantly XD orientation are enveloped by at least one stitch, and most by two adjacent stitches.

The strings are slit midway about between stitches. The cut ends of web fibers shorter than about ½ inch and consequently not engaged by stitches, is estimated at around 2% of the total weight of the stitch-bonded fabric. The overall denier of each string is estimated at approximately 36,000 grams/9,000 meters or equivalent to 4 g/meter.

Hot air at 250° F. is blown onto the slitted/cut strings in the following six different manners:

(A) the strips are restrained lengthwise (MD). The stitches are tightened around fibers, and there was no significant change in string length, similar in appearance to FIG. 1H.

(B) the strips are allowed to shrink lengthwise (MD) to approximately 60% of their length, developing an appearance similar to FIG. 1E and estimated at about 60,000 denier.

(C) the strips are cut to uniform 3-inch lengths and mixed with room temperature air at about 70° F. (RT) blowing into the cut strips before heating with blown hot air at 250° F., causing some of the cut pieces to shrink and curl in a manner similar to FIG. 2B.

(D) the strips are cut to 1-, 2-, 3- and 4-inch lengths, and mixed in equal weight portions (about ¼ of the total weight for each length) and then blown with RT air and then with the hot air at 250° F., creating a mixture of shrunk segments similar to FIGS. 1C, 1E, 2B and 2C.

(E) the strips are cut to 2-inch lengths and a mixture of % of the 2-inch cut length mixed with ¼ of chopped fibrous waste or recycled fibers before heating by hot air at 250° F. The recycled fibers were mostly caught by and between the longer fibers extending from the stitches.

(F) Control sample. A carded polyester web of 2.5-inch staple fibers, layered and bulked as much and as uniformly as possible using hand separation and hot air.

Testing:

About 1 ounce (about 25 grams) of each bulked mixture (A)-(F) was enclosed in a fabric pouch simulating a 12-inch by 12-inch mini-pillow. The pouches were first compressed by a centrally placed jug weighing 10 lbs. (about 4.5 kg) and then laundered for 3 cycles, and their bulk, softness, and recovery from compression of the samples were visually evaluated and compared. After testing each pouch was opened and examined for loose fibers not engaged and held by the strings. Preliminary, visual cross-comparisons of the performance of the samples showed the order of performance, arranging from best to worst, as shown below. The visual analysis indicates that the presence of the inventive strings had a clear beneficiary effect on bulk, and bulk retention. It also appeared to help retain the unsecured ends of the cut fibers within the projected fibers emanating from the stitches, to allow the use of chopped recycled fiber waste in a fiber-fill application, and to allow washing and drying without significant loss of bulk. Furthermore, the inventive strings appeared to avoid the "lumpy" feel of some of the chopped feathers or foam fillers.

Bulk . . . D, B, C, A, E, F

Bulk Recovery/Resilience . . . D, C, B, A, E, F

Loose short fibers after washing/drying . . . D, B, C, A, F, E

Bulk retention after washing/drying . . . B, D, C, A, E, F

Absence of surface "lumpiness" . . . D, F, C, B, A, E,

Example 2. Filling with Rolled Stitched Webs

The unstitched web of Example 1 is rolled and used to fill a 12-inch×12-inch mini pillow with one ounce (29 grams) of rolled web. An identical mini pillow is filled with one ounce (29 grams) of the inventive stitched fabric of Example 1 after it had been subjected to air dryer at 300° F. for 5 minutes and shrinking by approximately 35% in the machine direction and rolled in the machine direction. The two filled mini pillows rise to approximately 3 inches in the middle, developing an estimated internal volume of 300 $inch^3$, corresponding to a packed density of 0.06 $g/cm^3$. After washing and drying 3 times, the pillow containing the stitched web maintains its surface smoothness, bulk, uniformity, and resilience, while the pillow containing the unstitched web develops lumps and loses approximately one third of its midspan loft/height and one half of its volume.

Example 3. Rough Simulation of "Down Fill-Power"

The slit strips of Example 1 are chopped into 0.75-inch lengths after cold drawing and elongating by approximately 30%.

The chopped pieces are bulked by washing and drying in an air dryer at 300° F.

The average chopped string shrinks by 40% into nodules approximately 0.3 to 0.5 inches long, generally twisted, with 0.5-inch pile fibers emanating in essentially all directions in a manner similar to that shown in FIG. 1G.

In a rough simulation of the "fill power test" one ounce (29 grams) of the bulked nodules is placed into a vertical cylinder 11-inches in diameter and 12-inches tall A disc with a 10-inch diameter weighing approximately 100 grams is placed on top of the nodules.

The bulked nodules maintain a height of approximately 4.5 inches, corresponding to approximately 430 $inch^3$ per oz of fill, and a density of approximately 0.004 $gram/cm^3$, indicating a "fill-power rating" of at least 400. (Fill power is a measure of the loft or "fluffiness" of a down product that is loosely related to the insulating value of the down. The higher the fill power, the more air a certain weight of the down can trap, and thus the more insulating ability the down will have. Fill power ranges from about 300 ($in^3$/oz or 175 $cm^3$/kg or Lorch 75 mm/30 g) for feathers to around 900 ($in^3$/oz or 520 $cm^3$/g or Lorch 225 mm/30 g) for the highest quality goose down.)

Example 4. Comparisons with Commercial Pillows

Standard commercial 28-inch by 20-inch pillows sufficiently filled to rise at a mid-plateau of approximately 6 inches in height, and variously advertised to be filled with fibers, solid foams, chopped-foams, feathers and combinations of these filings including portions of natural bird down, required 750 to 2,400 grams of fill. They were compared to two pillowcases of the same dimensions, rising to the same level, containing the inventive fills:

Inventive pillow 1 was filled with the inventive mixture D of Example 1, which required only approximately 500 grams of fill.

Inventive pillow 2 was filled with 70 percent of mixture D and 30 percent of the bulked nodules of Example 3 and required only approximately 350 grams of fill.

Whereas the above comparisons represent rough laboratory examples, the inventive products appear to have a substantial advantage of durability, bulk and weight over general prior art. Further optimization, using different processing sequences within the scope of this invention, and including but not limited to combinations of web fiber denier, fiber type, fiber crimp and length, level of stitching, yarn weights, spans between stitches, altered sequences of slitting chopping and bulking, the use of temporary adhesive to stabilize the stitching process, and all of the remainder options mentioned above are available and included within the scope of this invention.

FIG. 6A is a photograph of an inventive fabric/stitched web made according to Example 1 having a basis weight of 4.9 $ounce/yard^2$ with a thickness of about 0.75-inch and a calculated density of 0.007 $g/cm^3$. The stitching yarns make up about 5% of the total weight of the stitched fabric. FIG. 6B is a photograph of several strips and chopped strips from an inventive stitched fabric similar to that in FIG. 6A including an as-stitched strip on the top, a bulked strip on the bottom and several chopped strips or nodules in the center. The bulked strings were shrunk to about 60% of their original length and described in treatment B of Example 1 and chopped into 0.75-inch segments. FIG. 6C is a photograph of a pile of chopped strings, as shown in FIG. 6B, measuring about 12 inches high and about 8 inches in diameter. The pile contains 58 grams or 2 ounces of chopped strings. The density of the pile is calculated to be about 0.006 $gram/cm^3$ (58 grams/9,879 $cm^3$). The chopped strings in the pile were made from a stitched web of about 0.35 $yd^2$ (0.3 $m^2$) and about 23-inch by 23-inch area, and bulked to about 0.21 $yd^2$ (0.18 $m^2$) and about 18-inch by 18-inch area. Slight hand pressure was used to form the chopped strings into a cylindrical container to form the pile.

As used herein, POY yarns, are yarns made from fibers of partially molecularly oriented polymer, which means fiber of synthetic organic crystalline polymer that has substantial molecular orientation, but which still can achieve further molecular orientation. Yarns of partially molecularly oriented fiber, sometimes referred to herein as "POY," are suited for use as stitching thread in the present invention and typically have a break elongation in the range of 50 to 150%. POY is described in U.S. Pat. No. 6,407,018, which is incorporated herein by reference in its entirety. As taught by the '018 patent, stitching threads of POY fibers typically have the capability of significant shrinkage when subjected, without restraint, to a low temperature heat treatment. For example, many a POY yarn can shrink to less than half its original length when immersed in boiling water. Also, typical POY fibers can be heat set, while being held at constant dimensions, at a temperature that is in the range of 120 to 190° C. The higher portion of the heat-setting temperature range (e.g., 165 to 190° C.) is preferred because the higher temperatures permit shorter exposure times to set the synthetic organic polymeric fibers. The fabric can be caused to shrink by being immersed in a relaxed condition in boiling water, or by being heated in a relaxed condition.

Induction heating, as described herein, can be accomplished by stitching, or sewing a resistive implant conductive material into the fabric or web. When electrical current flows through the resistive conductive material, it heats up to melt the nearby thermoplastic materials. To allow shrinkage of the linear stitches the conductive/resistive material is preferably in the form of powder or fine short fibrils attached to the stitching yarns or coextruded with at least one of the stitching yarns. Alternatively, a fine resistive-conductive wire is co-stitch-bonded along with a higher denier highly shrinkable yarn such as a POY yarn to form the shrinkable stitched lines, discussed herein. Afterward, to bulk, gather or shrink the stitch-bonded fabric/web an electrical current flows through the wire to heat, activate, gather the thermoplastic yarns. Resistive heating is described in U.S. Pat. No. 10,286,609, which is incorporated herein by reference in its entirety.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

What is claimed is:

1. A stitch-bonded fabric comprising a plurality of substantially parallel stitched lines on a web comprising substantially unbonded fibers, said plurality of stitched lines extending in a machine direction (MD) and the web fibers emanating from the plurality of stitched lines, wherein the plurality of stitched lines comprises a plurality of loops and said plurality of loops enclose substantially all of said web fibers, wherein the density of the stitched bonded fabric is less than 0.020 g/cm$^3$, and wherein a cross-direction (XD) spacing between adjacent stitch lines ranges from a lower limit of about 12.5 mm to an upper limit of about 75 mm.

2. The stitch-bonded fabric of claim 1, wherein the stitched bonded fabric is gathered to reduce a dimension of the plurality of loops holding said web fibers therewithin.

3. The stitch-bonded fabric of claim 1, wherein the density of the stitched bonded fabric is less than 0.015 g/cm$^3$.

4. The stitch-bonded fabric of claim 3, wherein the density of the stitched bonded fabric is less than 0.010 g/cm$^3$.

5. The stitch-bonded fabric of claim 4, wherein the density of the stitched bonded fabric is less than 0.005 g/cm$^3$.

6. The stitch-bonded fabric of claim 1, wherein the XD spacing ranges in any increments of 2.5 mm higher than the lower limit and lower the upper limit.

7. The stitch-bonded fabric of claim 1, wherein the XD spacing between adjacent stitch lines ranges from 25 mm to 50 mm (1.0 to 2.0 inches).

8. The stitch-bonded fabric of claim 7, wherein the XD spacing between adjacent stitch lines ranges from 25 mm to 37.5 mm (1.0 to 1.5 inches).

9. The stitch-bonded fabric of claim 1, wherein the XD spacing between adjacent stitch lines ranges from 12.5 mm to 37.5 mm (0.5 inch to 1.5 inches).

10. The stitch-bonded fabric of claim 1, wherein the plurality of stitched lines weighs less than 20% of the weight of the stitch-bonded fabric.

11. The stitch-bonded fabric of claim 10, wherein the plurality of stitched lines weighs less than 10% of the weight of the stitch-bonded fabric.

12. The stitch-bonded fabric of claim 11, wherein the plurality of stitched lines weighs less than 5% of the weight of the stitch-bonded fabric.

13. The stitch-bonded fabric of claim 12, wherein the plurality of stitched lines weighs less than 2% of the weight of the stitch-bonded fabric.

14. The stitch-bonded fabric of claim 1, wherein the plurality of stitched lines is formed by a heat shrinkable yarn, a POY yarn, a high-melt/low-melt yarn or an electrically conductive yarn.

15. The stitch-bonded fabric of claim 14, wherein the high-melt/low-melt yarn comprises a high melt yarn co-stitched with a low melt yarn, a core-sheath, or a bi-component yarn.

16. The stitch-bonded fabric of claim 1, wherein the web fibers further comprise at least one of crimped fibers, shrinkable fibers, non-shrinkable fibers, absorbent fibers or electrically conductive fibers.

17. A plurality of strings cut from the stitch-bonded fabric of claim 1, wherein each of the plurality of strings contains at least one stitched line.

18. A plurality of strings cut from the stitch-bonded fabric of claim 2, wherein each of the plurality of strings contains at least one stitched line.

19. The plurality of stitch-bonded strings of claim 17, wherein the plurality of strings is chopped and wherein a MD dimension of said chopped strings is 6-inch, 5-inch 4-inch, 3-inch, 2-inch, 1-inch or ½-inch, any length in between and any combination thereof.

20. The plurality of stitch-bonded strings of claim 18, wherein the plurality of strings is chopped and wherein a MD dimension of said chopped strings is 6-inch, 5-inch 4-inch, 3-inch, 2-inch, 1-inch or ½-inch, any length in between and any combination thereof.

* * * * *